US007785110B2

(12) United States Patent
Li

(10) Patent No.: US 7,785,110 B2
(45) Date of Patent: Aug. 31, 2010

(54) CONNECTOR

(76) Inventor: Yang-Yin Li, 3F-2, No. 61, Nanshun 6th St., Lujhu Township, Taoyuan County (TW)

( * ) Notice: Subject to any disclaimer, the term of this patent is extended or adjusted under 35 U.S.C. 154(b) by 21 days.

(21) Appl. No.: 12/230,190

(22) Filed: Aug. 26, 2008

(65) Prior Publication Data

US 2009/0197432 A1 Aug. 6, 2009

(30) Foreign Application Priority Data

Feb. 1, 2008 (TW) ..... 97202296 U

(51) Int. Cl.
*H01R 12/00* (2006.01)

(52) U.S. Cl. ..... 439/63

(58) Field of Classification Search ..... 439/63, 439/885, 581

See application file for complete search history.

(56) References Cited

U.S. PATENT DOCUMENTS 6,902,408 B2 * 6/2005 Yamane ..... 439/63
2003/0129858 A1 * 7/2003 Huang et al. ..... 439/63
2009/0117779 A1 * 5/2009 Zhang ..... 439/581

* cited by examiner

*Primary Examiner*—Phuong K Dinh
(74) *Attorney, Agent, or Firm*—Rosenberg, Klein & Lee

(57) ABSTRACT

A connector includes a grounding terminal, a signal terminal and an insulating casing. The grounding terminal has an annular body and two grounding portions extending from the bottom of the annular body. The signal terminal has a substrate. One end of the substrate is provided with a soldering portion, and the other end of the substrate is bent to form a hollow cylindrical contacting portion. The contacting portion is disposed in the annular body of the grounding terminal. A wings is formed respectively by means of extending horizontally and outwards from two sides the end of the substrate having the contacting portion. The insulating body covers the grounding terminal and the signal terminal. The grounding portion of the grounding terminal and the soldering portion of the signal terminal extend outside the insulating casing respectively.

12 Claims, 6 Drawing Sheets

CONNECTOR

BACKGROUND OF THE INVENTION

1. Field of the Invention

The present invention relates to a connector, and in particular to a connector which is applicable to radio frequency (RF) signal transmission.

2. Description of Related Art

With the development of science and technology, the dimensions of modern electronic products are reduced continuously. Accordingly, the dimensions of electronic elements (such as connectors) within the electronic products have also become more compact so as to correspond to the smaller electronic products.

Please refer to FIG. 1, which shows a small connector for transmitting RF signals. Such a connector can be inserted by a docking plug (not shown), thereby transmitting RF signals. The connector includes a grounding terminal 10*a*, a signal terminal 20*a* and an insulating casing 30*a*. The grounding terminal 10*a* has an annular body 11*a*. The signal terminal 20*a* has a substrate 21*a*. One end of the substrate 21*a* is provided with a soldering portion 22*a*. Near the other end of the substrate 21*a*, the signal terminal 20*a* is formed with a hollow cylindrical contacting portion 23*a* by means of a draw-forming process. The contacting portion 23*a* is disposed in the center of the annular body 11*a*. The insulating casing 30*a* is used to cover the grounding terminal 10*a* and the signal terminal 20*a*. The soldering portion 22*a* extends outside the insulating casing 30*a*.

However, when the above conventional connector is in use, the signal terminal 20*a* may become disconnected from the insulating casing 30*a* while the docking plug is inserted into or pulled out of the connector, because of the unsteady connection between the substrate 21*a* of the signal terminal 20*a* and the insulating casing 30*a*. Furthermore, since the contacting portion 23*a* of the signal terminal 20*a* is made by means of a draw-forming process, the roundness is poor, so that the signal transmission is unstable.

Consequently, because of the above limitation resulting from the technical design of prior art, the inventor strives via real world experience and academic research to develop the present invention, which can effectively improve the limitations described above.

SUMMARY OF THE INVENTION

The object of the present invention is to provide a connector in which the signal terminal can be combined with the insulating casing firmly. Thus, the signal terminal cannot become easily disconnected from the insulating casing when a docking plug is inserted into or pulled out of the connector.

In order to achieve the above objects, the present invention provides a connector, which includes: a grounding terminal having an annular body and at least one grounding portion extending from the bottom of the annular body; a signal terminal having a substrate, one end of the substrate being provided with a soldering portion, the other end of the substrate being bent to form a hollow cylindrical contacting portion, the contacting portion being disposed in the annular body of the grounding terminal; and an insulating body for covering the grounding terminal and the signal terminal, the grounding portion of the grounding terminal and the soldering portion of the signal terminal extending outside the insulating casing respectively; wherein two wings are formed by the substrate extending outwards horizontally in two opposite directions from the end of the substrate having the contacting portion.

The present invention has advantageous features as follows. Since the signal terminal has two wings, the contacting area between the signal terminal and the insulating casing can be increased, thereby increasing the coverage between the signal terminal and the insulating casing. In this way, the signal terminal can be combined with the insulating casing firmly. Furthermore, the contacting portion of the signal terminal is made by means of an over-molding process, its roundness is better. Thus, the effect of transmitting signals will be better.

In order to further understand the characteristics and technical contents of the present invention, a detailed description relating thereto will be made with reference to the accompanying drawings. However, the drawings are illustrative only, but not used to limit the scope of the present invention.

DETAILED DESCRIPTION OF THE PREFERRED EMBODIMENTS

Figure 1:
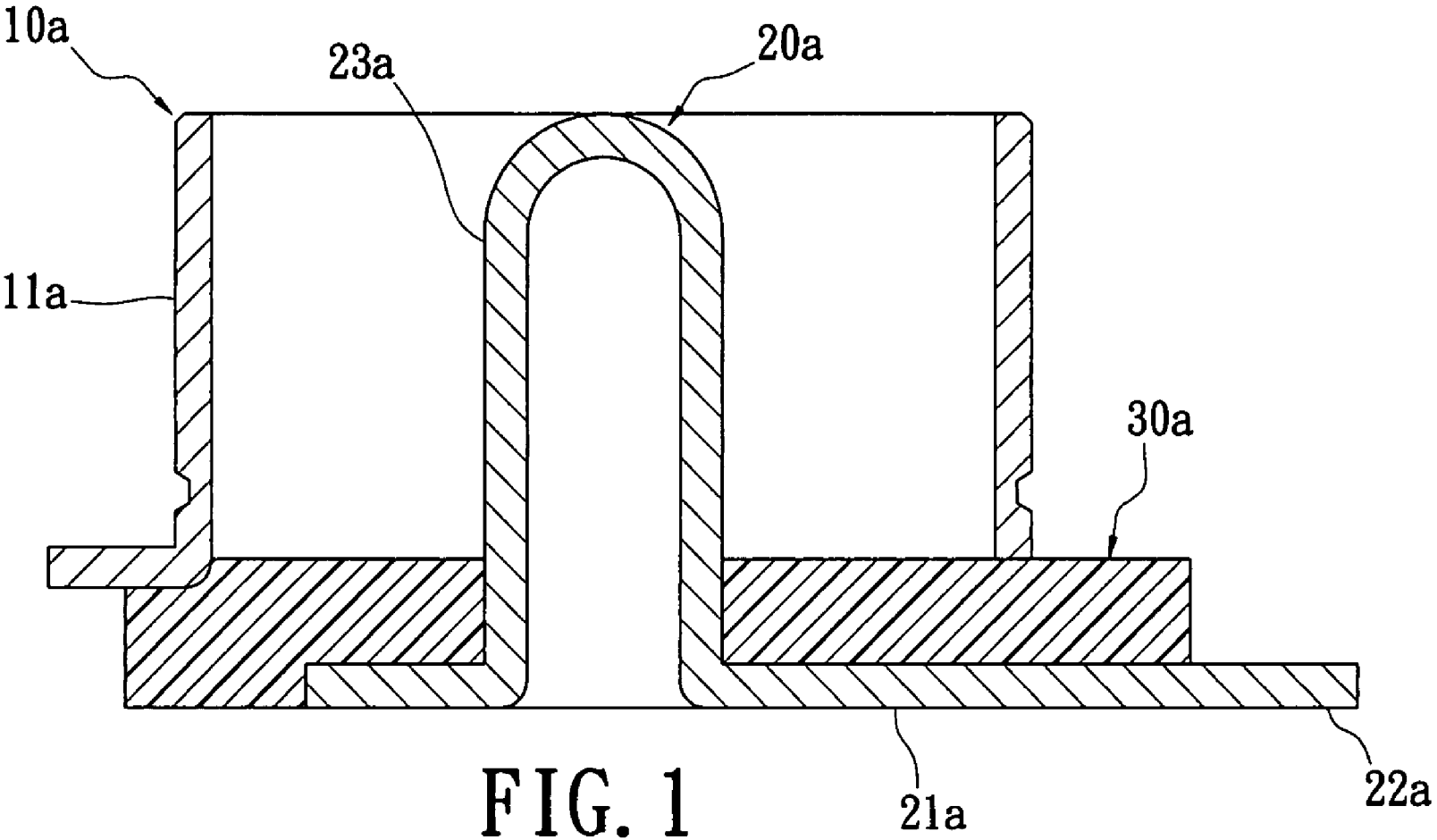
FIG. 1 PRIOR ART
FIG. 1 is cross-sectional view of a conventional connector.
Figure 3:
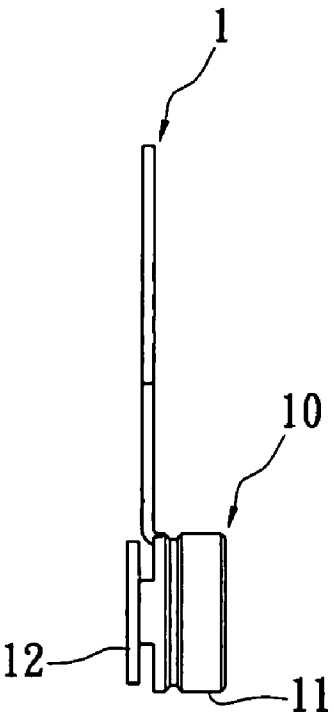
FIG. 3 is a left side view showing the grounding terminal raw material belt of the present invention.
Figure 2:
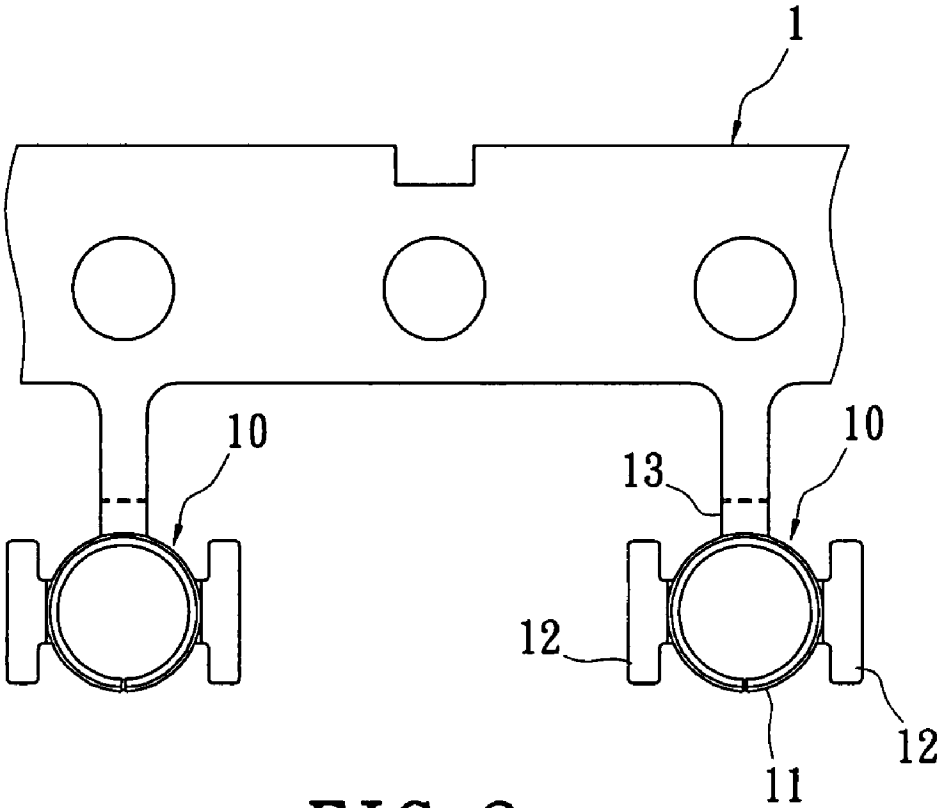
FIG. 2 is a front view showing the grounding terminal raw material belt of the present invention.
Figure 5:
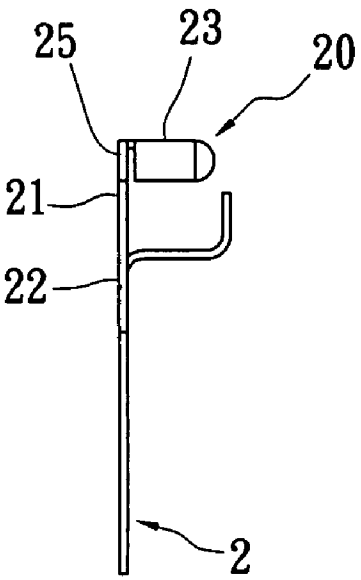
FIG. 5 is a left side view showing the signal terminal raw material belt of the present invention.

Please refer to FIGS. 2 to 7. The present invention provides a connector, which includes a grounding terminal 10, a signal terminal 20 and an insulating casing 30. The grounding terminal 10 is made of a metallic material having electric conductivity. Each of the grounding terminals 10 comprises an annular body 11 and at least one grounding portion 12 (also refer to FIG. 2). The annular body 11 is hollow.

The number of grounding portions 12 is not limited to a specific one. In the present embodiment, the grounding terminal 10 has two grounding portions 12, but it is not limited thereto. The two grounding portions 12 are formed into a sheet respectively and are formed by the bottom of the annular body 11 extending outwards in two opposite directions. Via the above arrangement, the grounding portions can be soldered on a circuit board (not shown), thereby connecting to the ground.

The signal terminal 20 is made of electrically conductive metallic materials. The signal terminal 20 has a substrate 21 that is formed into an elongated sheet. One end of the substrate 21 is provided with a soldering portion 22. The other end of the substrate 21 is bent with an angle of 90 degrees to form a contacting portion 23. The bottom of the contacting portion 23 is separated from the top surface of the substrate 21 by a distance (please refer to FIGS. 4 and 5).

The contacting portion 23 of the signal terminal 20 is formed by means of an over-molding process, so that the contacting portion is formed into a hollow cylindrical shape. The top end of the contacting portion 23 is formed into a curved surface with no holes. The contacting portion 23 is also formed with a vertically extending cutout 24 at the side adjacent to the soldering portion 22 (please refer to FIG. 6).

Figure 4:
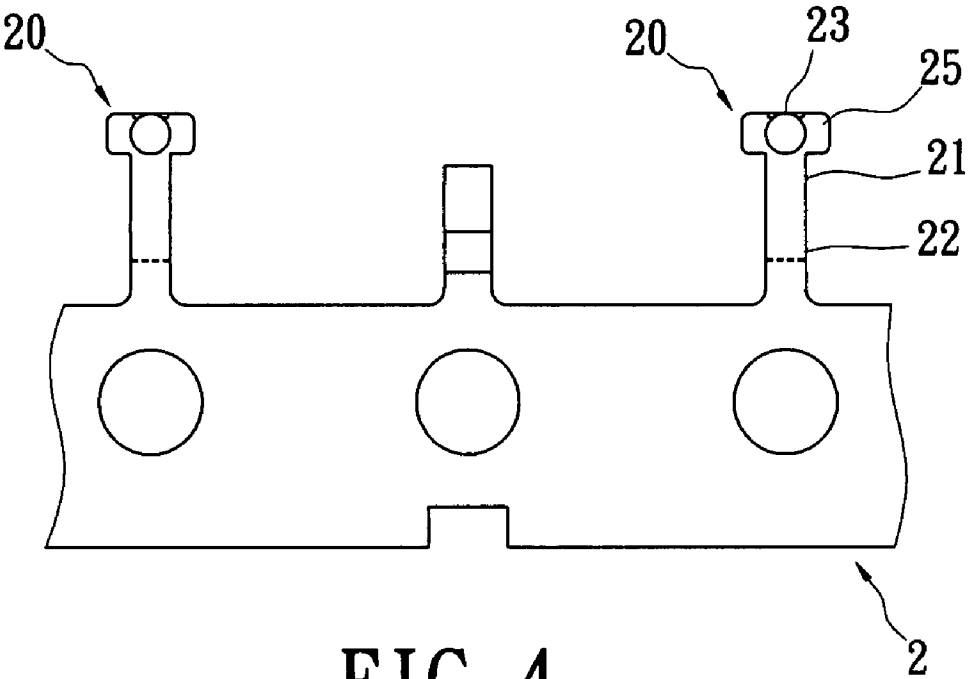
FIG. 4 is a front view showing the signal terminal raw material belt of the present invention.
Figure 6:
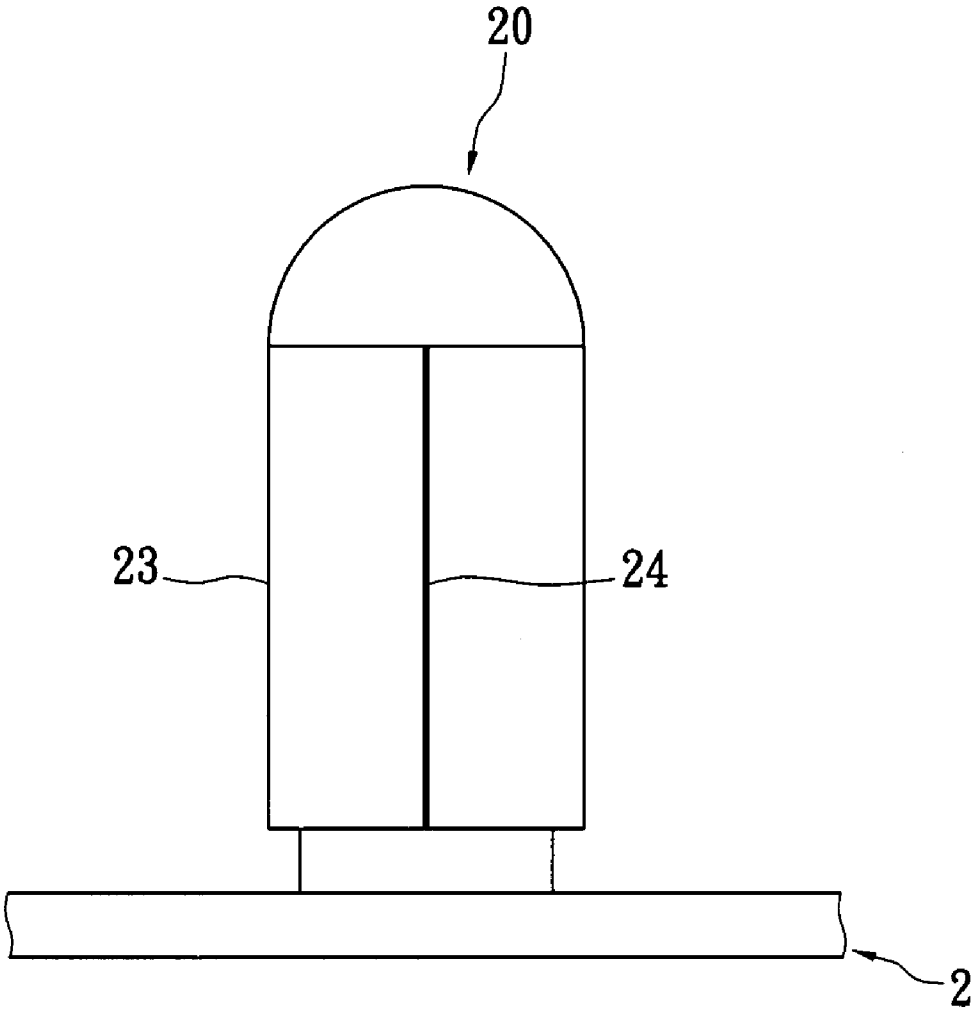
FIG. 6 is a bottom view showing the signal terminal raw material belt of the present invention.
Figure 7:
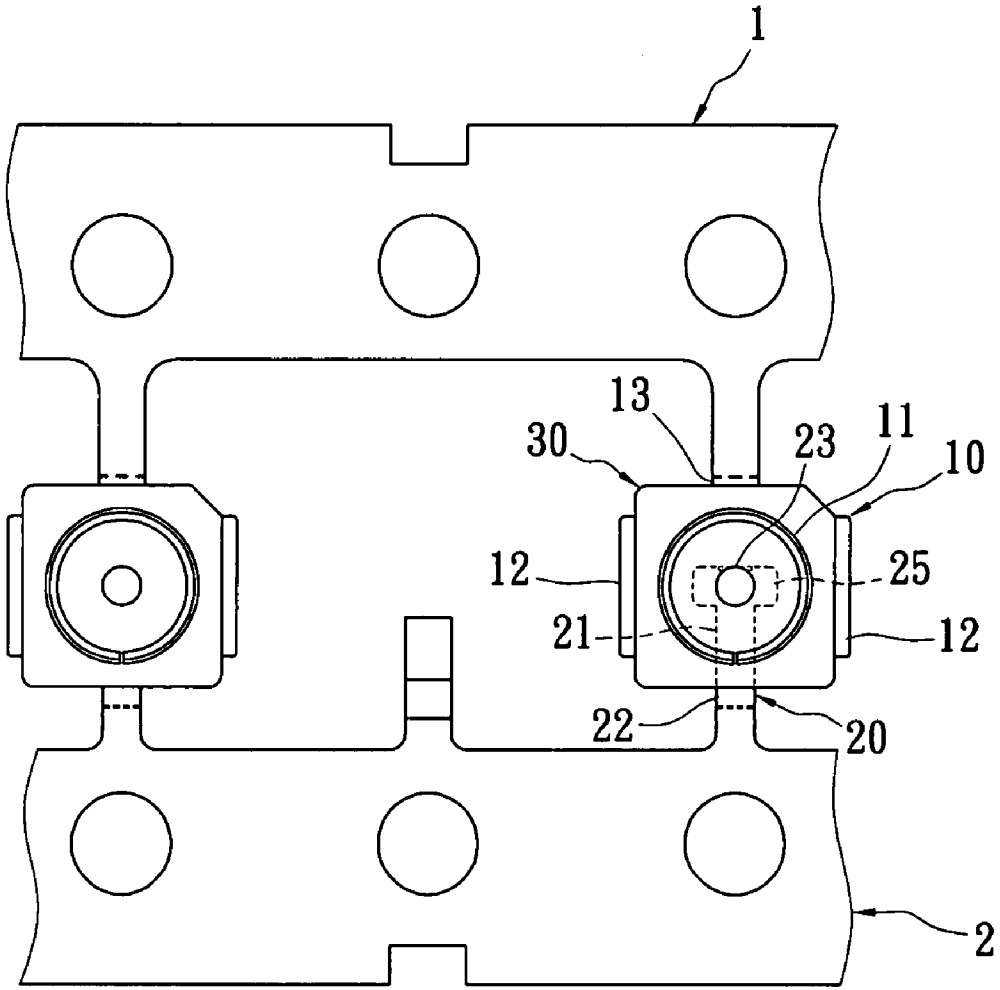
FIG. 7 is a front view showing the grounding terminal raw material belt and the signal terminal raw material belt of the present invention after the plastic injection-molding process.
Figure 9:
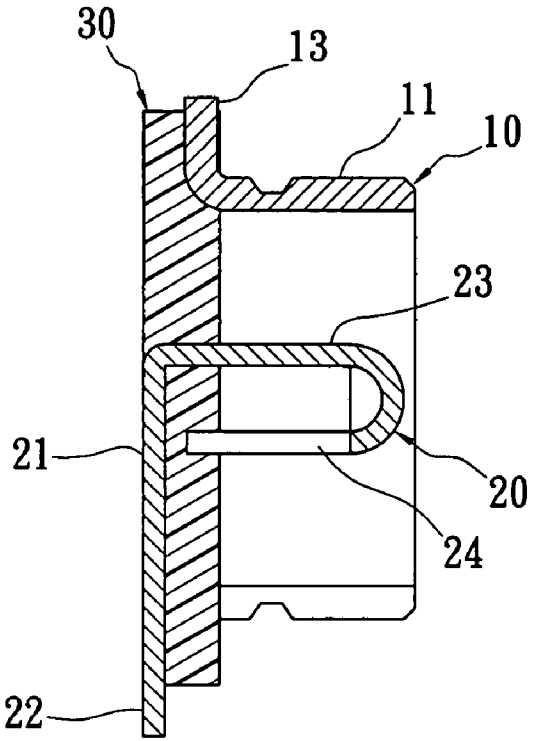
FIG. 9 is a cross-sectional view along the line 9-9 in FIG. 8.

The substrate 21 of the signal terminal 20 is formed with two sheet-like wings 25. The two wings 25 are formed by the substrate 21 extending outwards horizontally from two sides of the substrate 21 end having the contacting portion 23, so that the two wings 25 are located on both sides of the contacting portion 23. In the present embodiment, the width of the wing 25 is identical to the outer diameter of the contacting portion 23, but it is not limited thereto. As shown in FIG. 4, the two wings 25 and the substrate 21 together form a T shape.

The insulating casing 30 is made of plastics. After the signal terminal 20 is positioned in the grounding terminal 10, the bottom of the signal terminal 20 and the grounding portion 10 is covered by the insulating casing 30. The grounding portion 12 of the grounding terminal 10 and the soldering portion 22 of the signal terminal 20 extend outside the insulating casing 30 respectively. Both grounding portions 12 of the grounding terminal 10 can be soldered on the circuit board, thereby connecting to the ground. The soldering portion 22 of the signal terminal 20 is also soldered on the circuit board, thereby transmitting signals.

With the two wings 25, the contacting area between the signal terminal 20 and the insulating casing 30 is increased, so that the connection between the signal terminal 20 and the insulating casing 30 becomes tight and firm. Thus, the signal terminal 20 cannot easily become disconnected from the insulating casing 30.

Please refer to FIGS. 2 and 4 again, which show a grounding terminal raw material belt 1 and a signal terminal raw material belt 2. One side of the grounding terminal raw material belt 1 is connected with a plurality of grounding terminals 10. With the grounding terminal raw material belt 1, the manufacture of the grounding terminals 10 can be performed automatically in a production line.

The bottom of the annular body 11 of each grounding terminal 10 extends outwards to form a connecting portion 13 so as to connect to one side of the grounding terminal raw material belt 1. The connecting portion 13 is used to fix the annular body 11 of the grounding terminal 10, thereby facilitating the production of the grounding terminal 10.

One side of the signal terminal raw material belt 2 is also connected with a plurality of signal terminals 20, thereby facilitating the automatic production of the signal terminals 20. Each signal terminal 20 is connected to one side of the signal terminal raw material belt 2 via the soldering portion 22.

In manufacturing the connector of the present invention, the contacting portion 23 of the signal terminal 20 of the signal terminal raw material belt 2 is disposed in the center of the annular body 11 of the grounding terminal 10 of the grounding terminal raw material belt 1, and is then disposed in an injection-molding die. Via the plastic injection-molding process, the insulating casing 30 can be formed using plastics so as to cover the grounding terminal 10 and the signal terminal 20. The grounding portion 12 and the connecting portion 13 of the grounding terminal 10, and the soldering portion 22 of the signal terminal 20 extend outside the insulating casing 30 respectively (please refer to FIG. 7).

Figure 8:
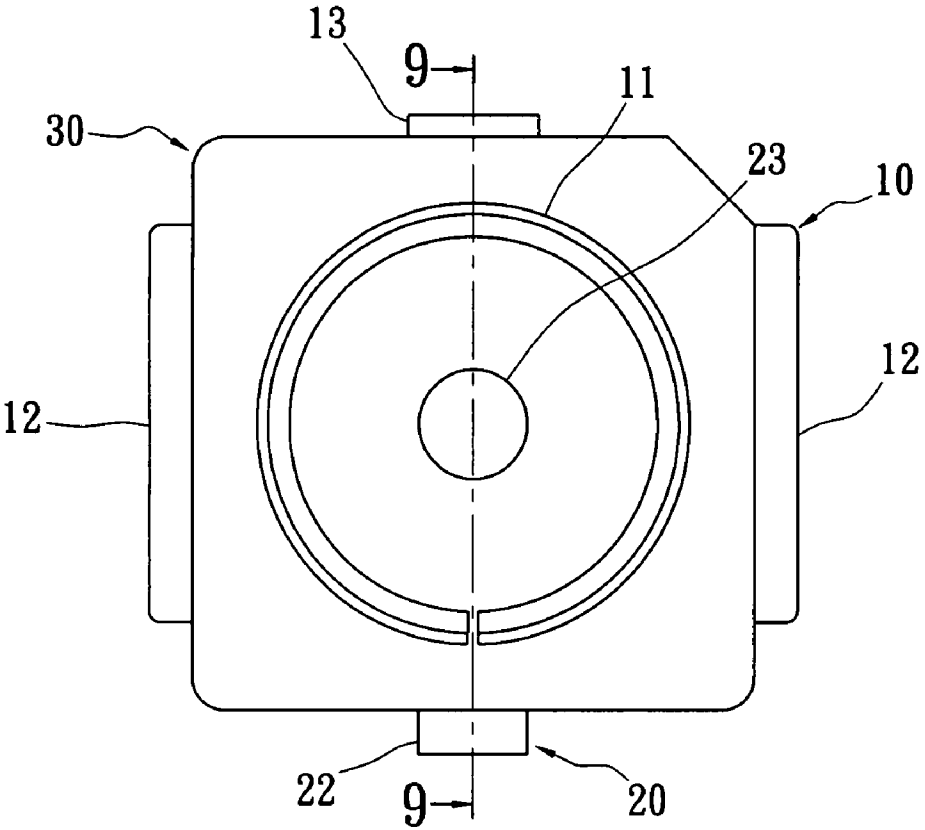
FIG. 8 is a front view showing the connector of the present invention.

Thereafter, the connecting point between the soldering portion 22 of the signal terminal 20 and the signal terminal raw material belt 2, and the connecting point between the connecting portion 13 of the grounding terminal 10 and the grounding terminal raw material belt 1 are cut, so that the connector as shown in FIG. 8 can be obtained. Therefore, the connector of the present invention is achieved by means of combining two sections of the raw material belts 1, 2 and the plastic injection over-molding process.

The connector of the present invention has advantageous features and functions as follows.

(I) With the two wings 25, the contacting area between the signal terminal 20 and the insulating casing 30 can be increased, so that the signal terminal 20 can be covered by the insulating casing 30 to a further extent. When the connector is inserted by a docking plug, the signal terminal 20 can be positioned on the insulating casing 30 firmly without easily becoming disconnected from the insulating casing 30. Thus, the connector of the present invention has a good hold after insertion.

(II) Since the contacting portion 23 of the signal terminal 20 is formed by means of an over-molding process with the cutout 24 extending vertically, the contacting portion 23 of the signal terminal 20 has better roundness. Since the signal terminal 20 has better roundness, it can generate a better signal-transmitting effect when being connected with the docking plug.

(III) Since the top end of the contacting portion 23 of the signal terminal 20 is not provided with any holes or apertures, the contact between the contacting portion 23 and the docking plug is perfect.

(IV) Since the contacting portion 23 of the signal terminal 20 has better roundness and its top end is not provided with any holes or apertures, the insulating casing 30 can be manufactured by a plastic injection-molding process in a more stable manner, which can increase the yield.

While the present invention has been described in terms of what is presently considered to be the most practical and preferred embodiments, it is to be understood that the present invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A connector, comprising:

a grounding terminal having an annular body and at least one grounding portion extending from the bottom of the annular body;

a signal terminal formed by punching and bending a metallic plate, having a substrate, a soldering portion formed at one end of the substrate, a contacting portion formed by punching and bent upwardly to be hollow cylindrical-shaped from the other end of the substrate, the contacting portion being disposed in the annular body of the grounding terminal;

a gap formed between the contacting portion and the substrate;

two wings extending respectively from two sides of the substrate and below the contacting portion; and an insulating casing covering the grounding terminal and the signal terminal, the grounding portion of the grounding terminal and the soldering portion of the signal terminal each extending outside the insulating casing;

wherein the insulating casing is formed via a plastic injection-molding process, and the insulating casing is injected inside a hollow portion of the contacting portion forming the gap, and is filled the gap between the contacting portion and the substrate.

2. The connector according to claim 1, wherein the contacting portion of the signal terminal is formed by means of an over-molding process.

3. The connector according to claim 1, wherein the top end of the contacting portion of the signal terminal is formed into a curved surface.

4. The connector according to claim 1, wherein the contacting portion of the signal terminal has a vertically extending cutout on one side adjacent to the soldering portion.

5. The connector according to claim 1, wherein the two wings of the signal terminal are located on both sides of the contacting portion, respectively, and the two wings are formed by means of extending outwards the substrate horizontally in two opposite directions.

6. The connector according to claim 1, wherein the wings of the signal terminal are formed into a sheet with its width identical to the outer diameter of the contacting portion.

7. A connector, comprising:

a grounding terminal having an annular body and at least one grounding portion extending from the bottom of the annular body;

a signal terminal defining an elongated substrate having a soldering portion and a contacting portion, said contacting portion having a first wall section integrally formed with said substrate and a second wall section disposed from said substrate whereby a gap is formed between said second wall section and said substrate;

an insulating casing positioned adjacent said contacting portion and between said substrate and said second wall section filling said gap, said insulating casing extending external said grounding terminal for contact with said soldering portion of said substrate; and a pair of wings connected to said substrate and extending from two sides of said substrate for contacting said insulating casing on a lower surface thereof.

8. The connector according to claim 7, wherein the contacting portion of the signal terminal is formed by means of an over-molding process.

9. The connector according to claim 7, wherein the top end of the contacting portion of the signal terminal is formed into a curved surface.

10. The connector according to claim 7, wherein the contacting portion of the signal terminal has a vertically extending cutout on one side adjacent to the soldering portion.

11. The connector according to claim 7, wherein the two wings of the signal terminal are located on both sides of the contacting portion, respectively, and the two wings are formed by means of extending outwards the substrate horizontally in two opposite directions.

12. The connector according to claim 7, wherein the wings of the signal terminal are formed into a sheet with its width identical to the outer diameter of the contacting portion.

* * * * *